US008119895B2

(12) United States Patent
Kitajima

(10) Patent No.: US 8,119,895 B2
(45) Date of Patent: Feb. 21, 2012

(54) KEYBOARD ASSEMBLY FOR ELECTRONIC MUSICAL INSTRUMENT

(75) Inventor: Mitsuru Kitajima, Shizuoka-ken (JP)

(73) Assignee: Yamaha Corporation (JP)

( * ) Notice: Subject to any disclaimer, the term of this patent is extended or adjusted under 35 U.S.C. 154(b) by 39 days.

(21) Appl. No.: 12/833,452

(22) Filed: Jul. 9, 2010

(65) Prior Publication Data

US 2011/0005370 A1 Jan. 13, 2011

(30) Foreign Application Priority Data

Jul. 9, 2009 (JP) ..... 2009-162549

(51) Int. Cl.
*G10C 3/12* (2006.01)

(52) U.S. Cl. ..... 84/423 R

(58) Field of Classification Search ..... 84/423 R, 84/44, 429–438, 441, 452 R
See application file for complete search history.

(56) References Cited

U.S. PATENT DOCUMENTS 7,485,798 B2 * 2/2009 Nishida ..... 84/644

FOREIGN PATENT DOCUMENTS

JP 2001-215968 A 8/2001

* cited by examiner

*Primary Examiner* — Kimberly Lockett
(74) *Attorney, Agent, or Firm* — Rossi, Kimms & McDowell LLP

(57) ABSTRACT

A keyboard assembly for an electronic musical instrument comprises an integrally formed multikey unit and a keyboard frame. The multikey unit has a plurality of juxtaposed key bodies and is comprised of three subunits, a sharp key subunit, a C-E-G-B key subunit and a D-F-A key subunit, which are complementary to each other to provide a key unit for a complete one octave. The rear end of each of the key body is extended downward to form a deformable thickness-reduced member to allow a vertical swing of the key body when depressed by a player. The thickness-reduced members are connected into a common connecting member to horizontally align the key bodies in the direction of juxtaposition. The keyboard frame has a vertical rear wall member and a rear top wall member both extending in the direction of the key body alignment, and guide ribs connecting the rear top wall member and the vertical rear wall member. In assembling, the common connecting member is first placed over the rear top wall member, thereafter is slid along the guide ribs, and is temporarily held at the correct position just behind the vertical rear wall member, before being fixed to the vertical rear wall member.

10 Claims, 9 Drawing Sheets

KEYBOARD ASSEMBLY FOR ELECTRONIC MUSICAL INSTRUMENT

TECHNICAL FIELD

The present invention relates to a keyboard assembly for an electronic musical instrument such as an electronic organ or an electronic piano in which the total depth (front to rear length) of the keyboard assembly is contrived to be minimal in view of the length of the playing areas of the keys.

BACKGROUND INFORMATION

In the field of electronic keyboard musical instruments and the like keyboard musical instruments, there have been known such keyboard assemblies as have a plurality of playing keys which are formed of a resin material and are swingably supported at their rear ends by a keyboard frame, as shown, for example, in unexamined Japanese patent publication No. 2001-215968. In such a keyboard assembly, each of a plurality of playing keys has a key body to be depressed by a player and an elastically deformable thickness-reduced member integrally extending vertically downward from the rear end of each key body, and the plurality of thickness-reduced members (for the plurality of key bodies each) are integrally connected to a common connecting member to horizontally align the key bodies in the direction of juxtaposition to constitute a multikey unit. The keyboard frame, on the other hand, has a vertical rear wall member to which is fixed the common connecting member of the multikey unit. Such a configuration is advantageous in minimizing the total depth of the keyboard assembly.

In such a conventional keyboard assembly, however, as the rear top wall member and the vertical rear wall member are formed perpendicular to each other, the configuration is disadvantageous in assembling the multikey unit to the keyboard frame, as the lower edge of the common connecting member of the multikey unit may bump against and be caught on the rear top wall member when the multikey unit is being mounted on the keyboard frame. Particularly in the case of a keyboard assembly which has swing mechanisms (e.g. swing weights) to simulate the key touch feeling of an acoustic piano, each of the key bodies is provided with an actuating member to actuate the associated swing mechanism, and accordingly the actuating members have to be engaged with the swing mechanisms in the course of mounting the multikey unit onto the keyboard frame. Such a procedure is likely to cause the lower edge of the common connecting member to bump against and be caught on the rear end of the rear top wall member. And further, the conventional keyboard assembly does not have a particular structure for accurately positioning the common connecting member during the assemblage of the multikey unit and the keyboard frame.

SUMMARY OF THE INVENTION

The present invention is, therefore, made to solve the aforementioned problems, and accordingly its primary object is to provide a keyboard assembly for an electronic musical instrument wherein the multikey unit can be easily assembled onto the keyboard frame.

According to the present invention, the object is accomplished by providing a keyboard assembly for an electronic musical instrument comprising: an integrally formed multikey unit having a plurality of juxtaposed key bodies each of which is extended downward from its rear end to form a deformable thickness-reduced member to allow vertical swing of the key body when depressed by a player, and having a common connecting member to which is connected the thickness-reduced members to horizontally align the key bodies in the direction of juxtaposition; and a keyboard frame having a vertical rear wall member and a rear top wall member positioned in front of and above the vertical rear wall member, the vertical rear wall member and the rear top wall member extending in the direction of the key body alignment, wherein the keyboard frame is provided with a guide member connecting the rear top wall member and the vertical rear wall member, whereby the multikey unit is to be mounted onto the keyboard frame by placing the common connecting member over the rear top wall member, thereafter sliding the common connecting member along the guide member, and finally fixing the common connecting member to the vertical rear wall member. In the above-mentioned structure, the guide member may preferably be provided in the form of ribs between the rear end of the rear top member and the top end of the vertical rear wall member. Alternatively, the guide member may be provided in the form of a slant wall connecting the rear end of the rear top member and the top end of the vertical rear wall member.

With the present invention configured as above, the multikey unit is smoothly mounted onto the keyboard frame, as the common connecting member slides along the guide member and is led to the vertical rear wall member. Thus the lower edge of the common connecting member will not be caught by the rear top wall of the keyboard frame in the course of mounting. This facilitates the process of assembling the multikey unit onto the keyboard frame.

In an aspect of the present invention, a first protrusion may be provided on the vertical rear wall member protruding rearward therefrom, wherein the common connecting member abuts against the first protrusion when the multikey unit is mounted onto the keyboard frame. With this configuration, when the multikey unit is mounted on the keyboard frame, the lower edge of the common connecting member abuts against the first protrusion so that the common connecting member is temporarily held at a determined position for fixing. This will eliminate the need of a jig or a measuring device for determining the position of the common connecting member before final fixing, thus facilitating the assembling process of the multikey unit onto the keyboard frame.

In another aspect of the invention, the common connecting member may have a cutaway provided from the lower edge of the common connecting member to engage with the first protrusion when the common connecting member is fixed to the vertical rear wall member. In this aspect, the first protrusion may preferably be configured in the form of a boss for fixing the common connecting member to the vertical rear wall member. Then, by engaging the cutaway with the first protrusion, not only the vertical position but also the horizontal position of the common connecting member can be determined correctly. Where the first protrusion for determining the fixing position is configured in the form of a boss for fixing the multikey unit onto the keyboard frame, the structure of the keyboard frame will be simplified.

In a further aspect of the present invention, a second protrusion may be provided on the vertical rear wall member protruding rearward therefrom in the form of a ridge extending on the vertical rear wall member in the direction of the key body alignment, while the common connecting member may be provided with a groove to match the second protrusion, so that the groove in the common connecting member will engage with the second protrusion on the vertical rear wall member in the process of fixing the common connecting member to the vertical rear wall member. This configuration will secure the correct vertical positioning of the common connecting member with respect to the vertical rear wall member in fixing the common connecting member to the vertical rear wall member by engaging the groove of the common connecting member with the second protrusion of the vertical rear wall member. In other words, this will eliminate the need of a jig or a measuring device for finally determining the position of the common connecting member to fix to the vertical rear wall member, thus facilitating the assembling process of the multikey unit onto the keyboard frame.

In a still further aspect of the present invention, the second protrusion may be protruded from the vertical rear wall member by an amount which is smaller than the thickness of the common connecting member. With this configuration, the thickness of the wall members of the keyboard frame can be made virtually uniform without a need of providing the keyboard frame with some thickness reductions (hollows) for improving the formability of the keyboard frame. This will simplify the structure of the mold for forming the keyboard frame and will reduce the manufacturing cost.

In a still further aspect of the present invention, the second protrusion may have a certain length of part extending in the direction of the key alignment which part is formed to have a horizontal surface area. In general, if the keyboard frame should be integrally molded from resin, the second protrusion would be shaped with a draft so that the upper surface of the second protrusion would descend toward the tip of the protrusion. Thus, if the multikey unit would move rearward to some extent during the process of fixing the common connecting member to the vertical rear wall member of the keyboard frame, the common connecting member would likely to slip off from the second protrusion. But with the above-mentioned configuration according to the present invention in which a certain length of part of the second protrusion is formed to have a horizontal surface area extending in the direction of the key alignment, the common connecting member would not easily slip off the second protrusion, even if the multikey unit might move rearward by some amount. Thus, this configuration will facilitate the procedure of fixing the common connecting member to the vertical rear wall member of the keyboard frame.

In a still further aspect of the present invention, the keyboard assembly can be provided with swing members which are supported by the keyboard frame, linked to the individual key bodies, respectively, and each of which swings according to the depression of each associated key body in order to simulate a key touch feeling of an acoustic piano. The configuration of the present invention will facilitate the procedure of assembling the multikey unit with the keyboard frame containing the swing members, while conventional configurations without the present invention would cause some difficulty in assembling the multikey unit onto the keyboard frame.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

In the following description, the front side of the keyboard assembly means the side directing toward the player (leftward in FIG. 1*a*), the rear side means the side directing away from the player (rightward in FIG. 1*a*), the right side means the side directing rightward of the player (front of the paper in FIG. 1*a*), the left side means the side directing leftward of the player (back of the paper in FIG. 1*a*), the up side means the side directing upward vertically (upper direction of the paper in FIG. 1*a*), and the down side means the side directing downward vertically (lower direction of the paper in FIG. 1*a*). The right-to-left direction as viewed by the player is termed herein the width direction, and the front-to-rear direction the depth direction.

Figure 1A:
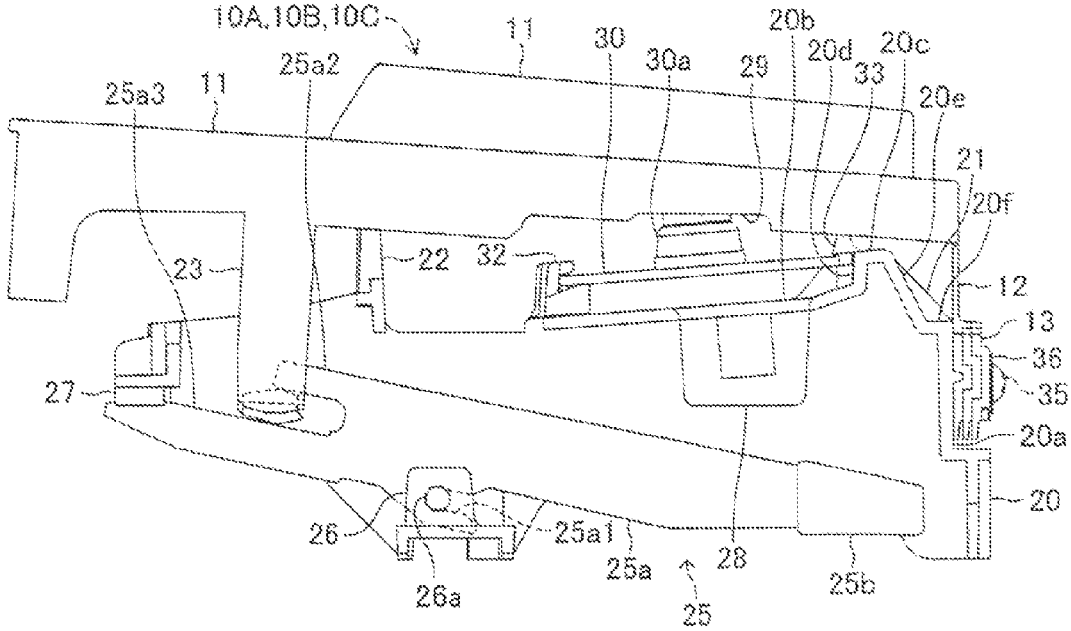
FIG. 1*a* is a right side view of a keyboard assembly in its assembled position according to an embodiment of the present invention.
Figure 1B:
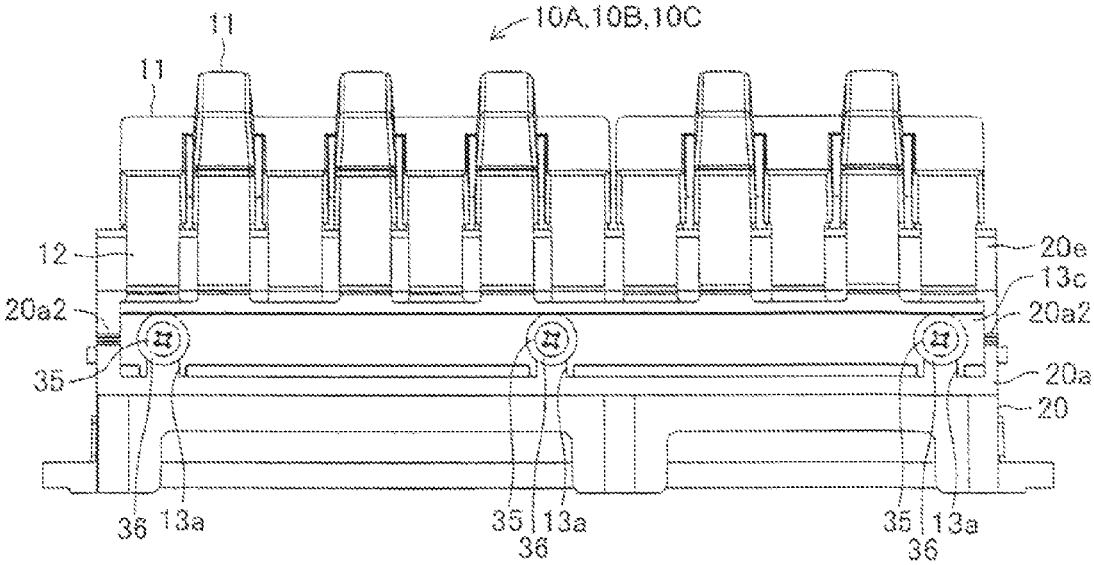
FIG. 1*b* is a rear view of the keyboard assembly of FIG. 1*a;*
Figure 2A:
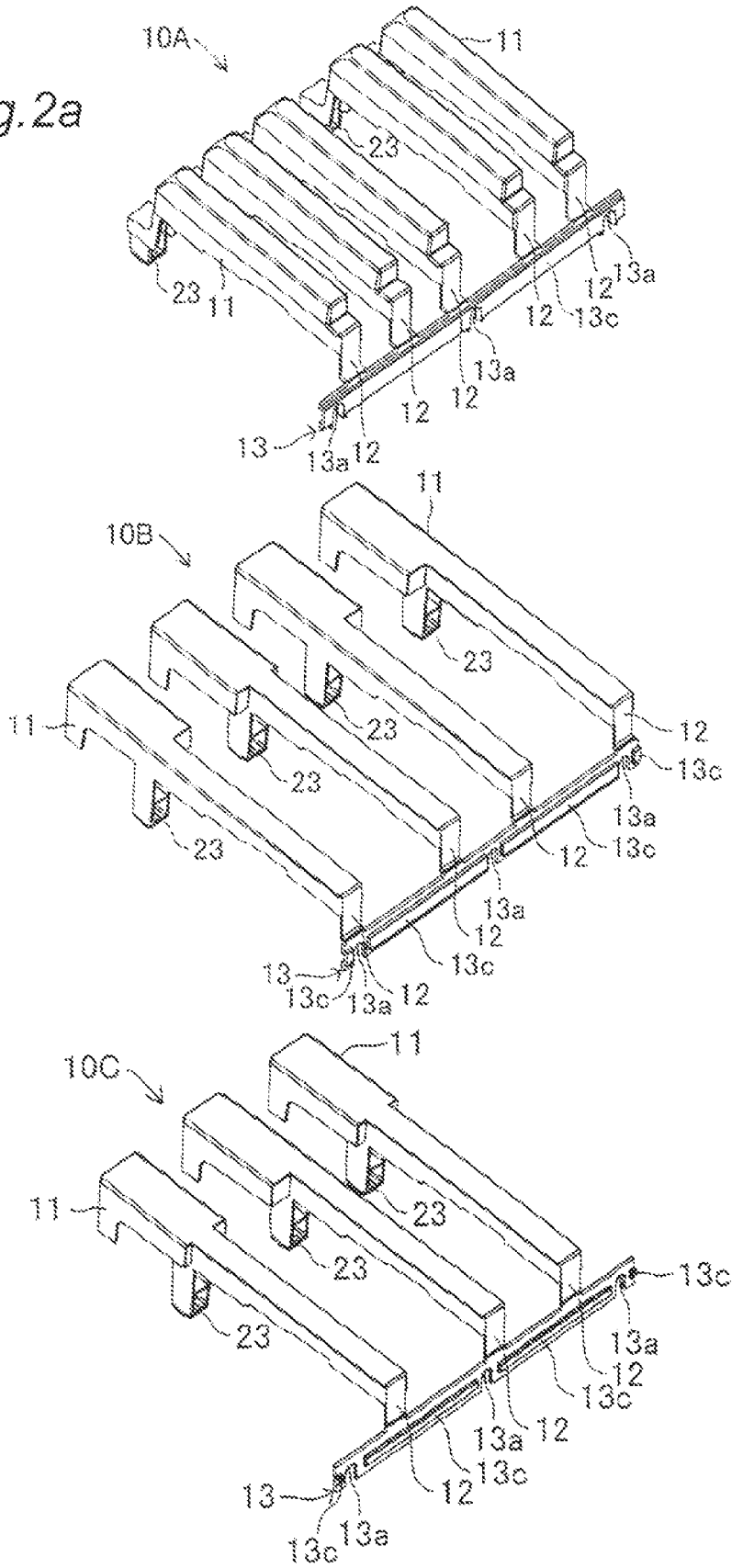
FIG. 2*a* is an exploded perspective view of a multikey unit included in the keyboard assembly of FIG. 1*a;*
Figure 2B:
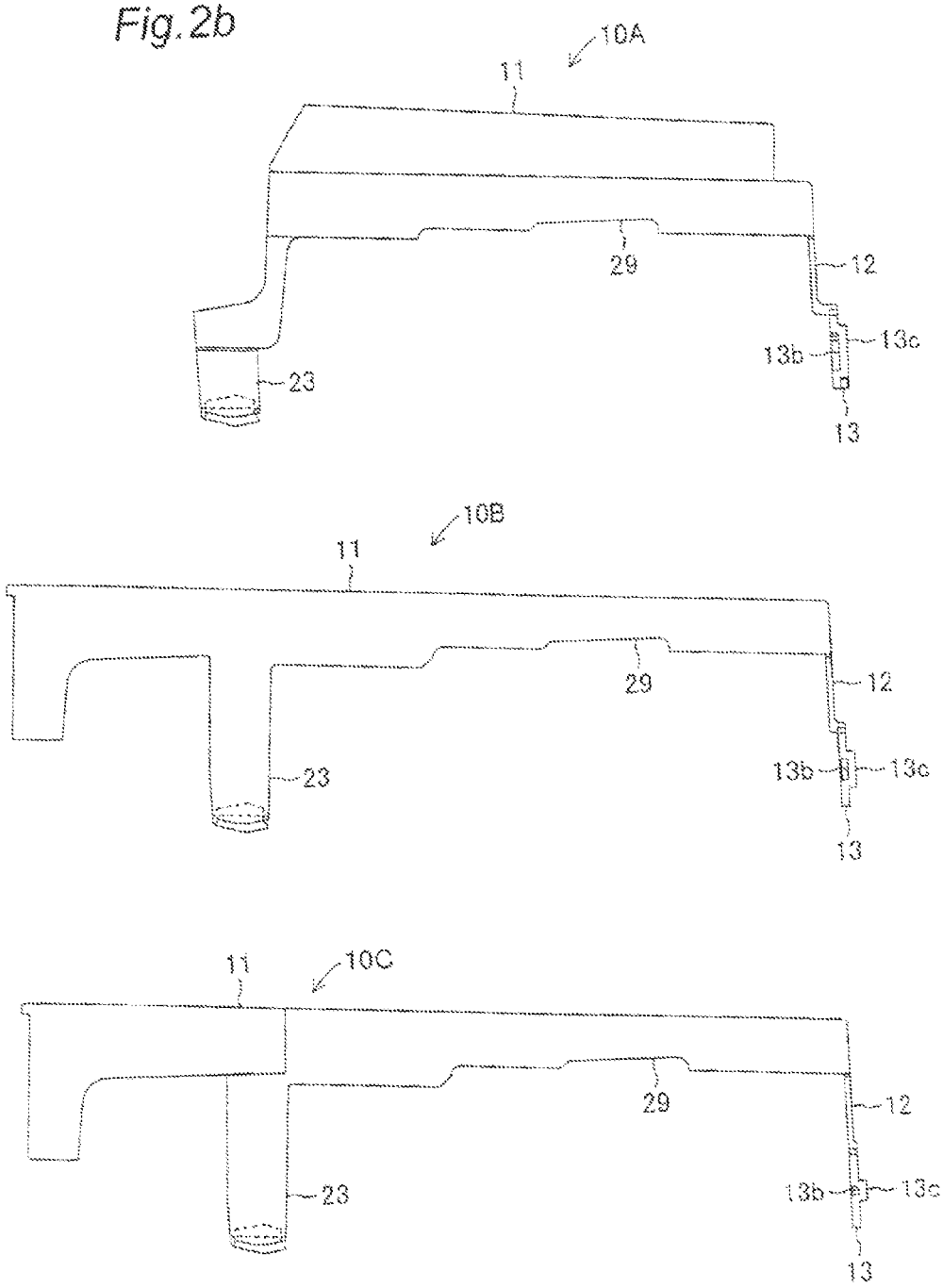
FIG. 2*b* is an exploded right side view of the multikey unit of FIG. 2*a;*
Figure 3A:
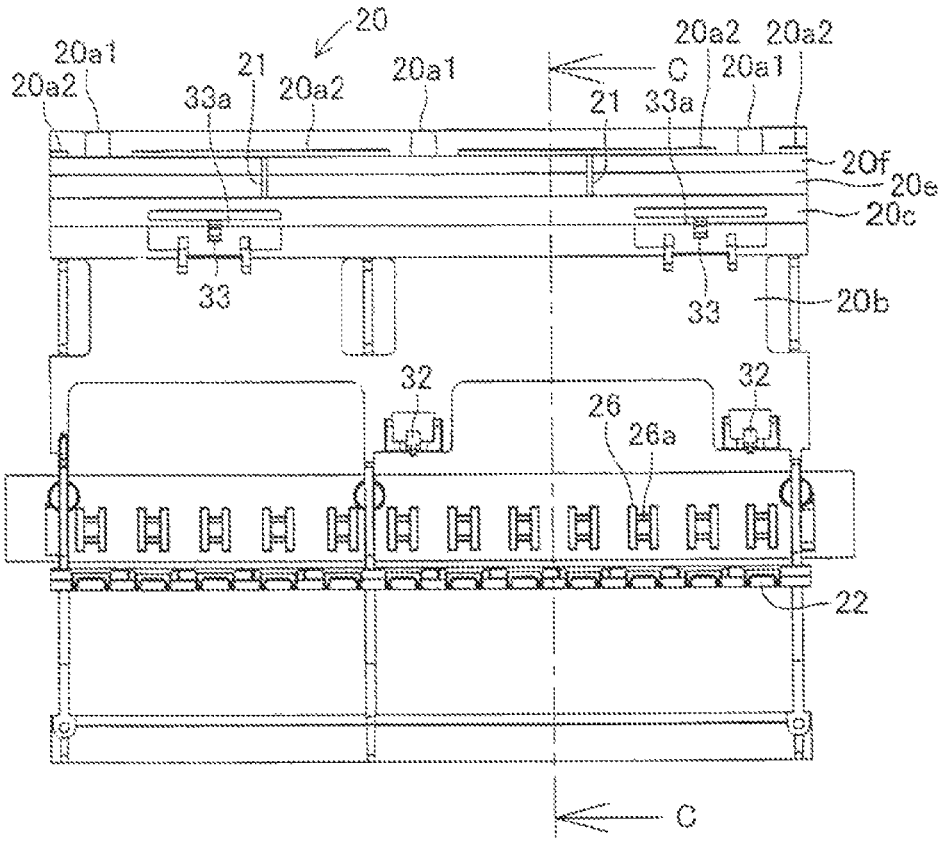
FIG. 3*a* is a plan view of the keyboard frame included in the keyboard assembly of FIG. 1*a;*
Figure 3B:
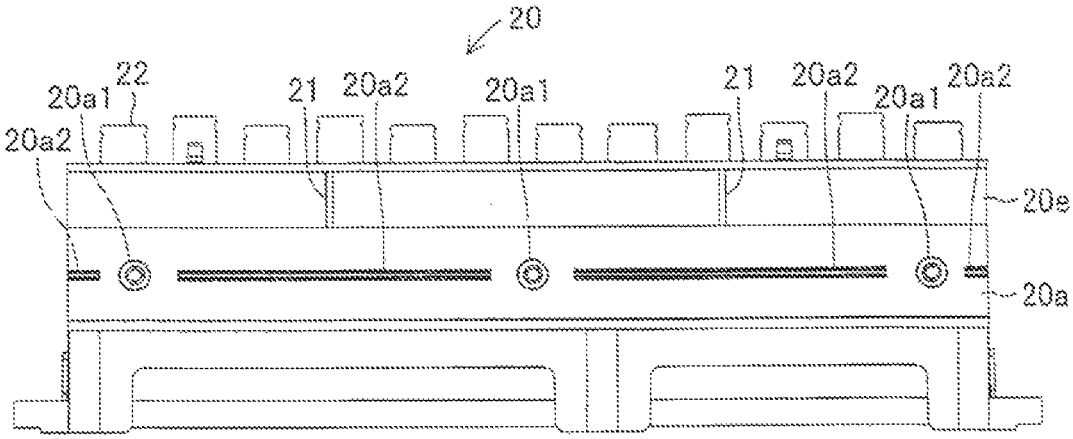
FIG. 3*b* is a rear view of the keyboard frame included in the keyboard assembly of FIG. 1*a;*
Figure 3C:
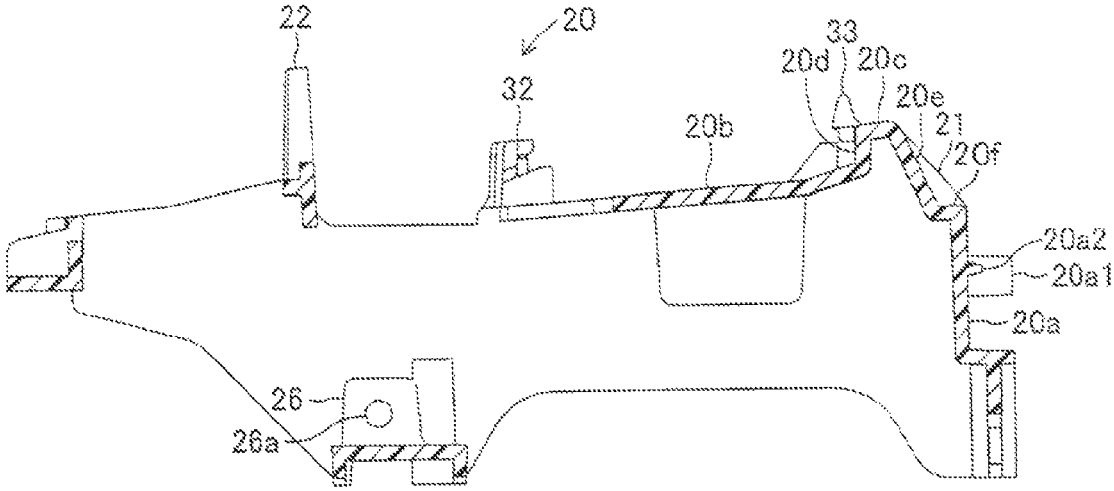
FIG. 3*c* is a cross-sectional side view of the keyboard frame taken along the line as viewed in the direction of the arrows C-C in FIG. 3*a;*

FIG. 1*a* is a right side view of a keyboard assembly in its assembled position according to an embodiment of the present invention, and FIG. 1*b* is a rear view of the keyboard assembly of FIG. 1*a*. The keyboard assembly comprises a keyboard frame 20 and a multikey unit 10A, 10B, 10C having a plurality of music playing keys fixed at their rear end parts to the keyboard frame 20. The multikey unit is comprised of three multikey subunits 10A, 10B and 10C as shown in FIGS. 2*a* and 2*b* by exploded perspective and right side views, respectively. The multikey subunit 10A has a C# key, a D# key, an F# key, a G# key and an A# key integrally formed of resin material. The multikey subunit 10B has a C key, an E key, a G key and a B key integrally formed of resin material.

The multikey subunit 10C has a D key, an F key and an A key integrally formed of resin material. While the shown examples of the multikey subunits are formed with particular combinations of several playing keys included within an octave, the combination and the range of the keys may not necessarily be limited to the shown examples, but may be arbitrarily selected.

Each of the multikey subunits 10A, 10B, 10C has a plurality of juxtaposed key bodies 11, thickness-reduced members 12 and a common connecting member 13, all formed integrally of resin material. The key body is a part of the key to be depressed by the player formed in the shape of a downward open hollow box having an elongate thin top wall member extending from front to rear, thin side wall members extending downward from the right and left edges of the top wall member, and a thin front member and a thin rear member extending downward from the front and rear ends of the top wall member. The thickness-reduced member 12 has a reduced thickness in the depth direction, and vertically extends downward from the rear wall member of the key body 11. The thickness-reduced member 12 may not necessarily be extended downward vertically from the rear wall member of the key body 11, but may be extended downward anyway from the rear part of the key body 11. The thickness-reduced member 12 is elastically deformable to allow vertical swing of the key body 11 when depressed by the player.

The common-connecting member 13 is formed in a shape which is elongate in the width direction and relatively thin in the depth direction, having a top end to which are connected the respective bottom ends of the thickness-reduced members 12. The common-connecting member 13 is provided with three cutaways 13*a* in a reversed U-shape (open downward) penetrating in the depth (thickness) direction of the common-connecting member 13. The three cutaways 13*a* are provided at the left end, center and right end regions of the common-connecting member 13, each commonly corresponding among the three multikey subunit 10A, 10B and 10C to each other. The reverse U-shape has an upper semicircle and a lower rectangle opening having a width equal to the diameter of the semicircle. All the cutaways 13*a* are open downward. The central cutaway 13 has the width of the opening a bit smaller than the width of the opening of the other cutaways 13.

Each of the common-connecting members 13 has a groove or channel 13*b* of a predetermined width (height as viewed by the player) extending along the length (in the width direction as viewed by the player) on the front surface of the member 13, and a ridge or rail 13*c* of a predetermined width extending along the length on the rear surface of the member 13. The width of the groove 13*b* on the multikey subunit 10C is made equal to the width of a rib 20*a*2 to be described herein later, and the width of the ridge 13*c* of the multikey subunit 10C is determined based on the width of its groove 13*b* so that the common-connecting member 13 is formed in a uniform thickness. As will be described herein later, the width of the groove 13*b* on the multikey subunit 10B is made a bit smaller than the width of the ridge 13*c* on the multikey subunit 10C, so that the groove 13*b* of the multikey subunit 10B and the ridge 13*c* of the multikey subunit 10C are tight fit to each other. The width of the ridge 13*c* on the multikey subunit 10B is determined based on the width of its groove 13*b* so that the common-connecting member 13 is formed in a uniform thickness. The width of the groove 13*b* on the multikey subunit 10A is made a bit smaller than the width of the ridge 13*c* on the multikey subunit 10B, so that the groove 13*b* of the multikey subunit 10A and the ridge 13*c* of the multikey subunit 10B are tight fit to each other. The width of the ridge 13*c* on the multikey subunit 10A is determined based on the width of its groove 13*b*. As all the grooves 13*b* are made in the same depth, all the ridges 13*c* are made in the same height. As the multikey subunits 10A, 10B and 10C are assembled together by lapping one common connecting member 13 on another successively, the ridge 13*c* of the multikey subunit 10C fits in the groove 13*b* of the multikey subunit 10B and the ridge 13*c* of the multikey subunit 10B fits in the groove 13*b* of the multikey subunit 10A to make an integrated multikey unit for an octave. Alternatively, several pins may be provided integrally on the rear surface of the common connecting member 13 of the multikey subunit 10C protruding rearward and the corresponding number of through holes may be provided in the common connecting members 13 of the multikey subunits 10A and 10B at the positions to receive the pins of the multikey subunit 10C in order to integrate the multikey subunits 10A, 10B and 10C into one piece by fitting the pins into the corresponding through holes.

The keyboard frame 20 is formed of resin by integral molding and is elongate in the width direction. The keyboard frame 20 has a vertical rear wall member 20*a* standing vertically and extending elongate in the width direction, and a middle upper wall member 20*b* and a rear top wall member, each lying approximately horizontal and extending elongate in the width direction. The rear top wall member 20*c* is positioned in front of and above the vertical rear wall member 20*a*. The middle upper wall member 20*b* is positioned in front of and lower than the rear top wall member 20*c*. The rear end of the middle upper wall member 20*b* and the frond end of the rear top wall member 20*c* are connected by a vertical wall member 20*d*, which is also elongate in the width direction. Thus, a stepped configuration is formed by the middle upper wall member 20*b* and the rear top wall member 20*c* in the upper region of the keyboard frame 20.

From the rear end of the rear top wall member 20*c* is extended a slant wall member 20*e* extending rearward and downward. The lower end of the slant wall member 20*e* is positioned in front of the upper end of the vertical rear wall member 20*a*. A horizontal wall member 20*f* is provided extending rearward from the lower end of the slant wall member 20*e*, and the rear end of the horizontal wall member 20*f* is connected to the upper end of vertical rear wall member 20*a*. Over the slant wall member 20*e* and the horizontal wall member 20*f* are provided a plurality of ribs 21 at intervals in the width direction, not necessarily at regular intervals but can be at different intervals. The upper surface of the rib 21*c* is formed as a slope linking the rear end of the rear top wall member 20*c* and the upper end of the vertical rear wall member 20*a*. The slant wall member 20*e* and the horizontal wall member 20*f* may be omitted, as long as the ribs 21 connect the vertical rear wall member 20*a* and the rear top wall member 20*c*. In such a case, however, the number of ribs 21 had better be increased in order to secure the strength of the keyboard frame 20, as compared with the case in which the slant wall member 20*e* and the horizontal wall member 20*f* are both provided.

On the rear surface of the vertical rear wall member 20*a* are provided bosses 20*a*1 as first protrusions in the right end part, the center part and the left end part in the width direction. The diameter of the boss 20*a*1 is equal to the width the cutaway 13*a* in the center part among other parts of the multikey subunit 10A, 10B, 10C. When the multikey subunits 10A, 10B and 10C are assembled on the keyboard frame 20, the cutaways 13*a* are slip fit over the bosses 20*a*1.

Also on the rear surface of the vertical rear wall member 20*a* are provided ribs 20*a*2 as second protrusions extending in the width direction. The ribs 20*a*2 are provided at a bit higher position than the center of the bosses 20*a*1. The ribs 20*a*2 are not provided in the vicinity of the bosses 20*a*1, but are provided apart from the bosses 20*a*1 with some intervals in the width direction of the keyboard frame 20. The width of the rib 20*a*2 is smaller than the diameter of the boss 20*a*1, and is of the order of a half of the thickness of the keyboard frame 20. The ribs 20*a*2 are formed with a draft angle to facilitate the release of the molded keyboard frame 20 from the mold. In this connection, the rib 20*a*2 is shaped narrower toward its tip (i.e. rearward). In other words, the upper surface is inclined downward toward the tip, and the lower surface is inclined upward toward the tip. The height (size in the depth direction) of the rib 20*a*2 is made equal to the thickness of the common connecting member 13 (i.e. depth of the groove 13*b*) of the multikey subunit 10C. The ribs 20*a*2 are to fit in the groove 13*b* of the multikey subunit 10C when the multikey subunits 10A, 10B and 10C are assembled on the keyboard frame 20.

As shown in FIG. 1, a key guide 22 provided in the front region of the keyboard frame 20 comes into the hollow space at the middle part of the key body 11 from below to guide the key body 11 to swing vertically when depressed and released, restricting its widthwise deviation. An actuating member 23 is provided extending downward from the front part of the key body 11. The actuating member 23 is formed in a hollow channel shape open rearward having a front thin wall extending downward from the key body 11 and side thin walls extending downward from the key body 11 and rearward from the left and right ends of the front thin wall. The lower end of the actuating member 23 is closed with a bottom wall.

Below the key body 11 is provided a swing lever 25 as a member which swings in accordance with the swing movement of the key body 11 and exerts an inertia force to the key body 11 in order to simulate the key touch feeling on the acoustic piano. The swing lever 25 is comprised of a lever body 25*a* made of synthetic resin and a weight piece 25*b* made of metal. The lever body 25*a* is a member in the shape of a plate having a hook member 25*a*1 in its lower part and is supported by a lever fulcrum 26 having a pin 26*a* so that the lever body 25*a* is rotatable around the axis of the pin 26*a*. The lever body 25*a* is further provided in its front part with a pair of upper and lower fork members 25*a*2 and 25*a*3, the upper one 25*a*2 being formed shorter than the lower one 25*a*3. Between the fork members 25*a*2 and 25*a*3 is inserted the bottom wall of the actuating member 23 of the key body 11. A shock absorbing member made of rubber, urethane, felt or the like is attached to the bottom wall of the actuating member 23 to mediate an impact caused by a collision between the bottom wall of the actuating member 23 and the upper surface of the lower fork member 25*a*3 and a collision between the bottom wall of the actuating member and the lower surface of the upper fork member 25*a*2. While the key body 11 is released, the front part of the swing lever 25 displaces upward due to the own weight of the swing lever 25 and of the weight piece 25*b*. Under this condition, the actuating member 23 is urged upward by means of the fork member 25*a*3, and the front part of the key body 11 is displaced upward. On the other hand, when the key body 11 is depressed, the bottom wall of the actuating member 23 pushes the upper surface of the fork member 25*a*3 downward, and the front part of the swing lever 25 is displaced downward.

The weight piece 25*b* is formed in the shape of a plate and is fixed to the rear end of the lever body 25*a*. All of the weight pieces 25*b* may be of the same weight for all the key bodies 11, but may be of lighter weight successively from the lowest note key toward the highest note key, key by key or key region by key region, in order to faithfully simulate the key touch feeling on the acoustic piano.

To the lower surface of the front part of the keyboard frame 20 is fixed an elongate upper stopper 27 constituted by a shock absorbing material such as felt extending in the width direction. The upper stopper 27 restricts an upward displacement of the front part of the swing lever 25, which in turn restricts an upward displacement of the front part of the key body 11 while released. To the lower surface of the middle upper wall member 20*b* of the keyboard frame 20 is fixed an elongate lower stopper 28 constituted by a shock absorbing material such as felt extending in the width direction. The lower stopper 28 restricts an upward displacement of the rear part of the swing lever 25, which in turn restricts a downward displacement of the front part of the key body 11 when depressed.

On the lower surface of the middle part of the key body 11 is formed a switch-actuating part 29. The switch-actuating part 29 abuts the upper surface of a key switch 30*a* arranged on a circuit board 30. The key switch 30*a* is provided for every key body 11, and detects the depressed or released condition of the corresponding key body 11 by being actuated in accordance with the swing movement of the corresponding key body 11. The keyboard frame 20 is integrally formed with a solid support 32 and an elastic support 33 for fixedly support the circuit board 30. The solid support 32 is provided in the front part of the middle upper wall member 20*b*. The elastic support 33 is provided at the stepped part formed by the middle upper wall member 20*b* and the rear top wall member 20*c* of the keyboard frame 20, having a deformable member 33*a* which is elastically deformable in the depth direction. The deformable member 33*a* is elastically deformed, when the circuit board 30 is fixed, pressing the circuit board 30 to the solid support 32. Thus the circuit board 30 is held between the solid support 32 and the elastic support 33. There are a plurality of solid supports 32 and elastic supports 33 provided, respectively, at intervals in the width direction, not necessarily at regular intervals but can be at different intervals.

Hereinafter will be explained the procedure of fixing the multikey subunits 10A, 10B and 10C to the keyboard frame 20 in the keyboard assembly structured as described above. To begin with, the three multikey subunits 10A, 10B and 10C are combined together to constitute an integrated multikey unit for one octave, by fitting the ridge 13*c* of the multikey subunit 10C in the groove 13*b* of the multikey subunit 10B, and the ridge 13*c* of the multikey subunit 10B in the groove 13*b* of the multikey subunit 10A. As the corresponding ridges 13*c* and grooves 13*b* of the multikey subunits 10A, 10B and 10C are tight fit together, the integrated multikey unit would not separate easily from each other, even if some amount of force should be applied to the multikey subunits 10A, 10B and 10C. As will be understood, the combined multikey subunits 10A, 10B and 10C constitute an integrated multikey unit for one octave with the seven natural (white) keys and the five sharp (black) keys juxtaposing one after another in the width direction.

Figure 4:
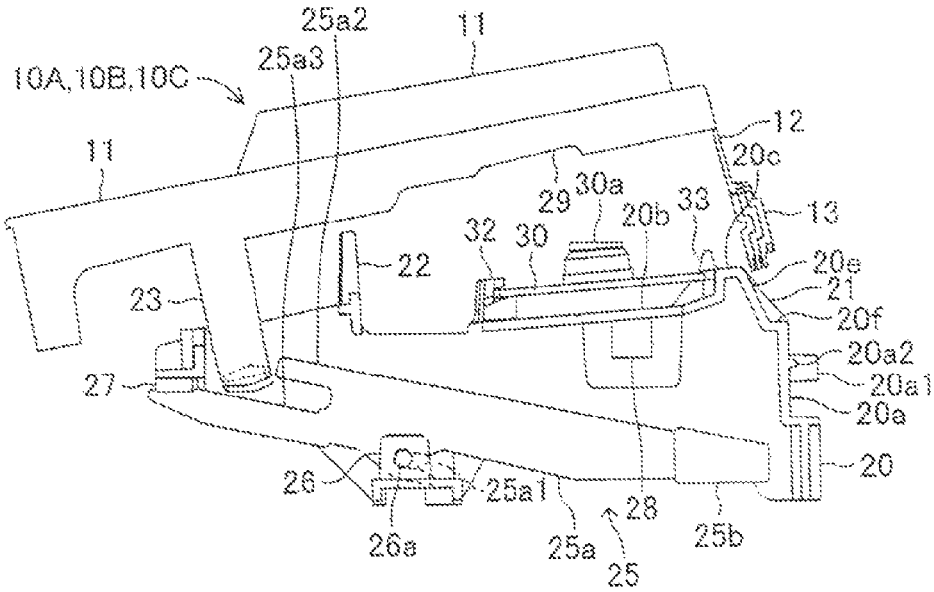
FIG. 4 is a side view of the keyboard assembly under the process of mounting the multikey unit onto the keyboard frame, in which the actuating member is brought close to the swing lever.
Figure 5:
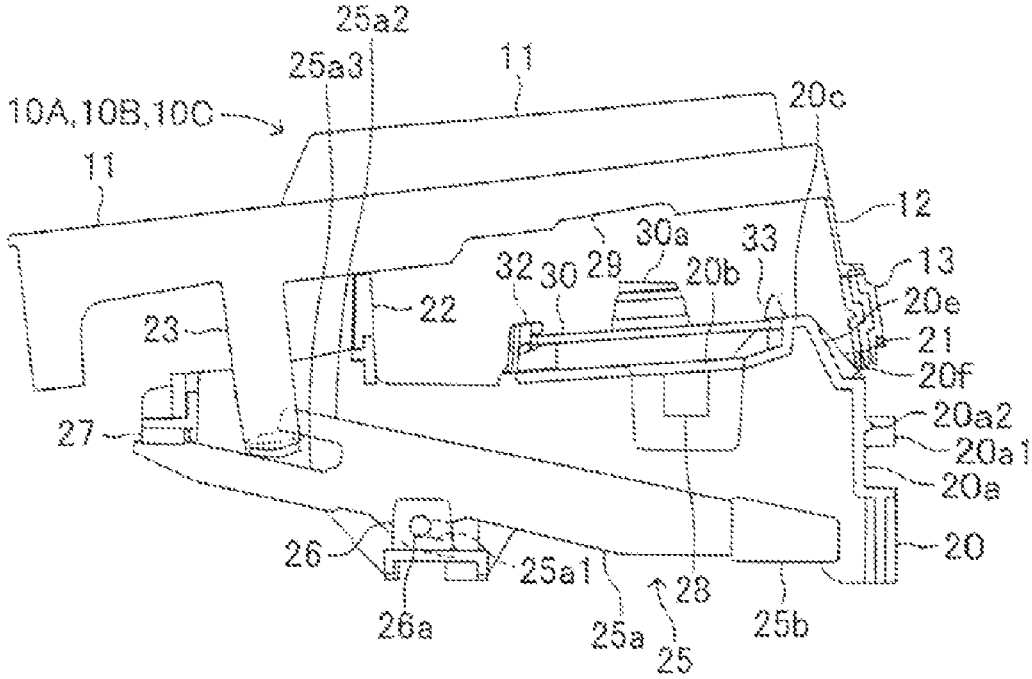
FIG. 5 is a side view of the keyboard assembly under the process of mounting the multikey unit onto the keyboard frame, in which the common connecting member is sliding along the guide member toward the vertical rear wall member with the actuating member engaging with the swing lever.

In assembling the combined multikey unit 10A, 10B, 10C to the keyboard frame 20, the combined multikey unit 10A, 10B, 10C is held aslant with its front part positioned lower than its rear part as shown in FIG. 4, the lower end of the actuating member 23 is brought closer to the upper surface of the fork member 25*a*3 of the swing lever 25. In this position, the lower edge of the integrated common connecting member 13 is just above the ribs 21. And then, as shown in FIG. 5, the integrated multikey unit 10A, 10B, 10C is slid rearward with the bottom wall of the actuating member 23 entering between the fork members 25*a*2 and 25*a*3 and with the rear part of the integrated multikey unit 10A, 10B, 10C being lowered. The integrated common connecting member 13 is guided down to the vertical rear wall member 20*a* with its lower edge sliding along the upper surface of the ribs 21.

Figure 6A:
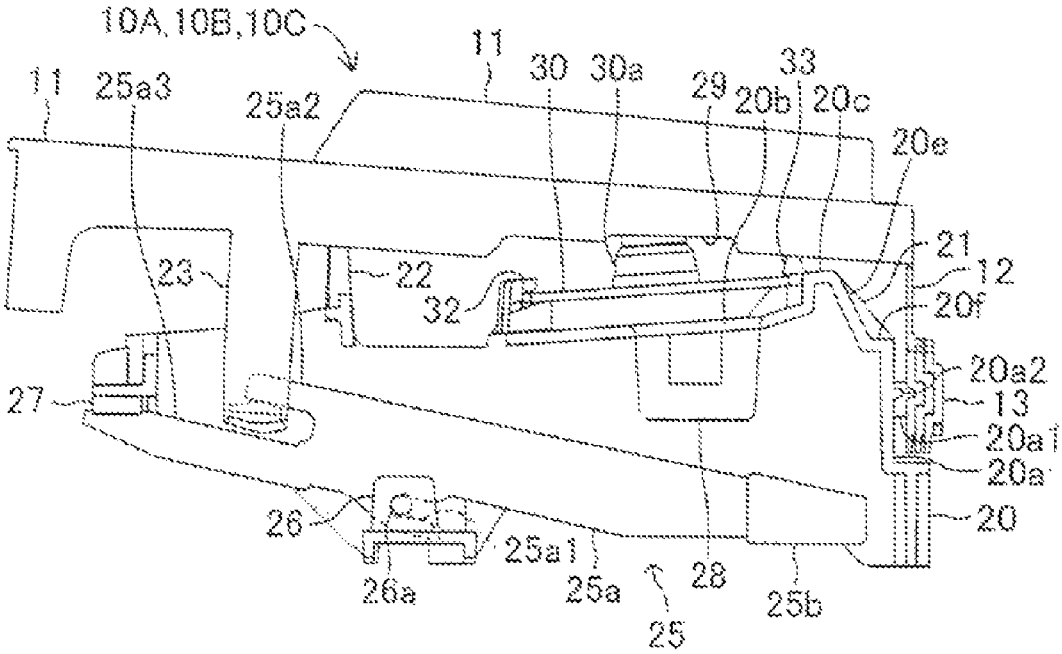
FIG. 6*a* is a side view of the keyboard assembly with the common connecting member temporarily positioned in place just before getting assembled.
Figure 6B:
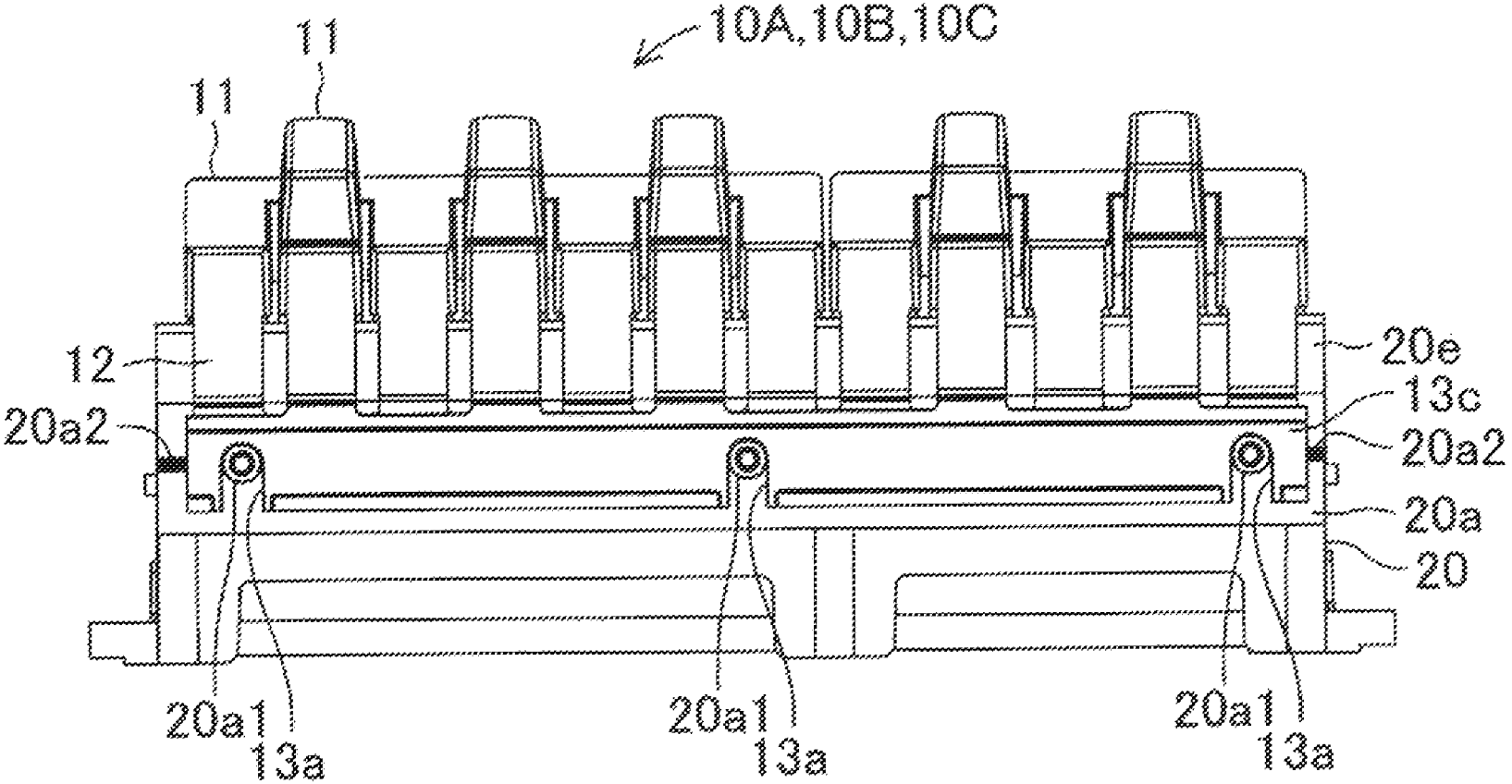
FIG. 6*b* is a rear view of the keyboard assembly with the common connecting member temporarily positioned in place just before getting assembled.

Thereafter, as shown in FIGS. 6*a* and 6*b*, the cutaways 13*a* of the integrated common connecting member 13 which have been guided down to the vertical rear wall member by means of the ribs 21 are coupled to the bosses 20*a*1 on the vertical rear wall member 20*a*. Thus, the integrated multikey unit 10A, 10B, 10C is temporarily placed at the correct vertical position just before getting assembled. Further, as the width of the cutaway 13 provided in the middle part of the common connecting member 13 is made equal to the diameter of the boss 20*a*1, the integrated multikey unit 10A, 10B, 10C is correctly positioned also in the width direction. Under this condition, the groove 13*b* of the multikey subunit 10C is positioned a bit apart rearward and downward from the ribs 20*a*2.

Next, the integrated common connecting member 13 is pulled a bit forward and upward to bring the ribs 20*a*2 into the groove 13*b* of the multikey subunit 10C. Then, a screw 35 is screwed through a washer 36 into each of the bosses 20*a*1 to fix the integrated common connecting member 13 to the keyboard frame 20. In this way, the integrated common connecting member 13 is finally set at the correct position, and the integrated multikey unit 10A, 10B, 10C has got assembled onto the keyboard frame 20.

According to the above-described embodiment, the integrated common connecting member 13 is guided by the ribs 21 down to the vertical rear wall member 20*a*, when the integrated multikey unit 10A, 10B, 10C is being mounted on the keyboard frame 20. The assembling process will be facilitated, as the common connecting member 13 would not abut or hitch on the upper portion of the keyboard frame 20. The integrated multikey unit 10A, 10B, 10C can be assembled to the keyboard frame 20 by simply engaging the groove 13*b* with the rib 20*a*2 and screwing the screws 35 into the bosses 20*a*1, which process will dispense with precise adjustment of the assembling position using a particular jig or measuring device. The bosses 20*a*1 are used also as the protrusions for temporarily resting the integrated common connecting member 13. This is advantageous in that the structure of a metal mold for manufacturing the keyboard frame 20 will be simplified, cutting down the manufacturing cost, as compared with the case where separate protrusions are provided for temporary resting or positioning the multikey unit. Further in the above-described embodiment, the height of the rib 20*a*2 is designed as small as the thickness of the thin common connecting member 13 of one multikey subunit. Thus the thickness of the vertical rear wall 20*a* of the keyboard frame 20 is virtually uniform and there would be no need of providing a thickness-reduced portion (hollow) on the front surface of the keyboard frame 20 opposite to (i.e. behind) the rib 20*a*2. This also serves to cut down the manufacturing cost, as the structure of a metal mold will be simplified.

The present invention is not necessarily limited to the above described embodiment, but may be variously modified without departing from the spirit of the invention.

In the above embodiment, the cutaways 13*a* on the common connecting member 13 are engaged with the bosses 20*a*1 to temporarily positioning the common connecting member 13. However, separate protrusions for temporary positioning may be provided on the vertical rear wall member 20*a* in addition to the boss 20*a*1, so that the cutaways 13*a* would engage such separate protrusions for temporary positioning. The shape of such separate protrusions may not necessarily be limited to a circular column like the bosses 20*a*1 but may be of other arbitrary shape (e.g. square pole) as long as they are protruded rearward from the vertical rear wall member 20*a*, and the shape of the cutaways 13*a* is formed to match the shape of such protrusions for temporary positioning. In such a case, the cutaways 13*a* may be formed a little bit larger than the above-described embodiment so that the bosses 20*a*1 would not touch the cutaways 13*a*, when the integrated multikey unit 10A, 10B, 10C is mounted on the keyboard frame 20. In other words, the temporary positioning of the common connecting member 13 is realized by the separate protrusions for the temporary positioning, and the bosses 20*a*1 are used only for fixing (i.e. screwing) the common connecting member 13. In such a way, the temporary positioning of the common connecting member 13 can be effected as in the above-described embodiment. The separate protrusions for temporary positioning may not receive the cutaways 13*a* but may simply receive the lower edge of the common connecting member 13. With such a configuration, the temporary positioning, in the vertical direction, of the common connecting member 13 can be accomplished as in the case of the above-described embodiment. In such a case, however, the positioning in the width direction will be effected by matching the cutaway 13*a* with the boss 20*a*1.

Figure 7:
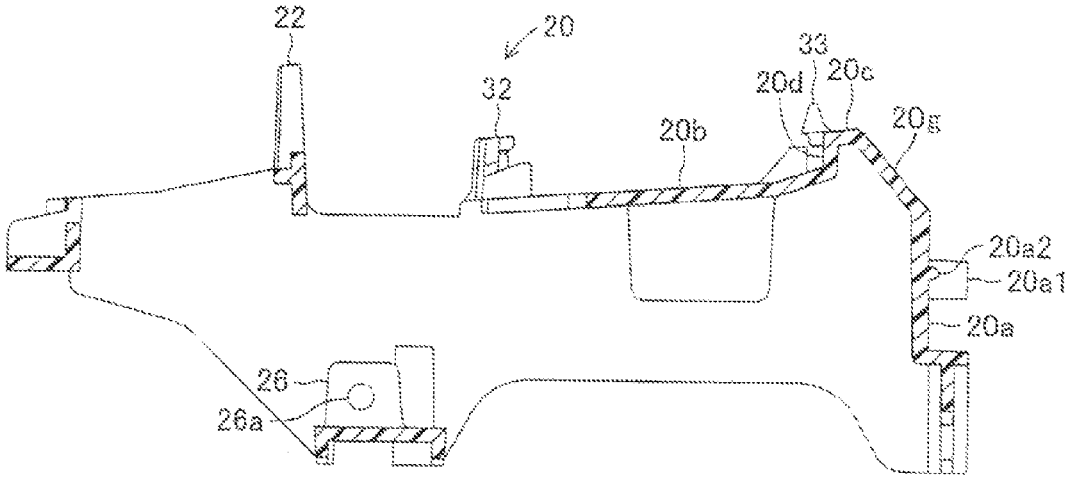
FIG. 7 is a cross-sectional side view of a keyboard frame according to a modified embodiment of the present invention.

In the above-described embodiment, the ribs 21 are provided over the slant wall member 20*e* and the horizontal wall member 20*f* to guide the lower edge of the common connecting member 13 sliding along the upper edge of the ribs 21 down to the vertical rear wall member 20*a*. However, the slant wall member 20*e*, the horizontal wall member 20*f* and the ribs 21 may be replaced by a single slant wall member 20*g* in the shape of a plain plate connecting the rear end of the rear top wall member 20*c* and the top end of the vertical rear wall member 20*a*, as shown in FIG. 7. The slant wall member 20*g* may not necessarily be in the shape of a flat plane, but may be of a curved plate as long as it is inclined downward (i.e. descending) toward the rear direction. With such a configuration, the lower edge of the common connecting member 13 can slide along the slant wall member 20*f* to reach the vertical rear wall member 20*a*, so that the integrated multikey unit 10A, 10B, 10C can be easily assembled onto the keyboard frame 20.

Figure 8A:
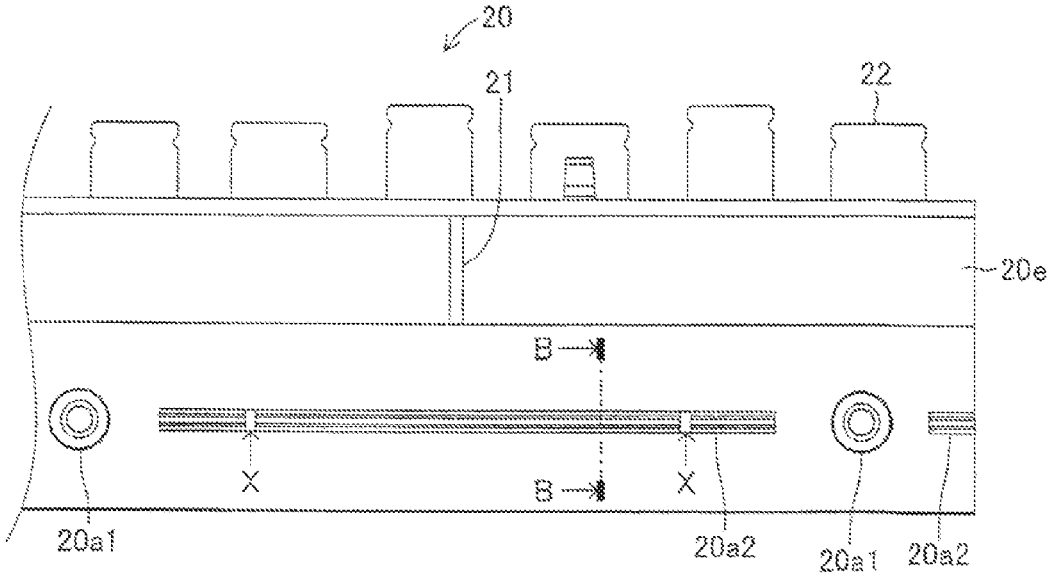
FIG. 8*a* is a partial rear view of a keyboard frame according to another modified embodiment of the present invention.
Figure 8B:
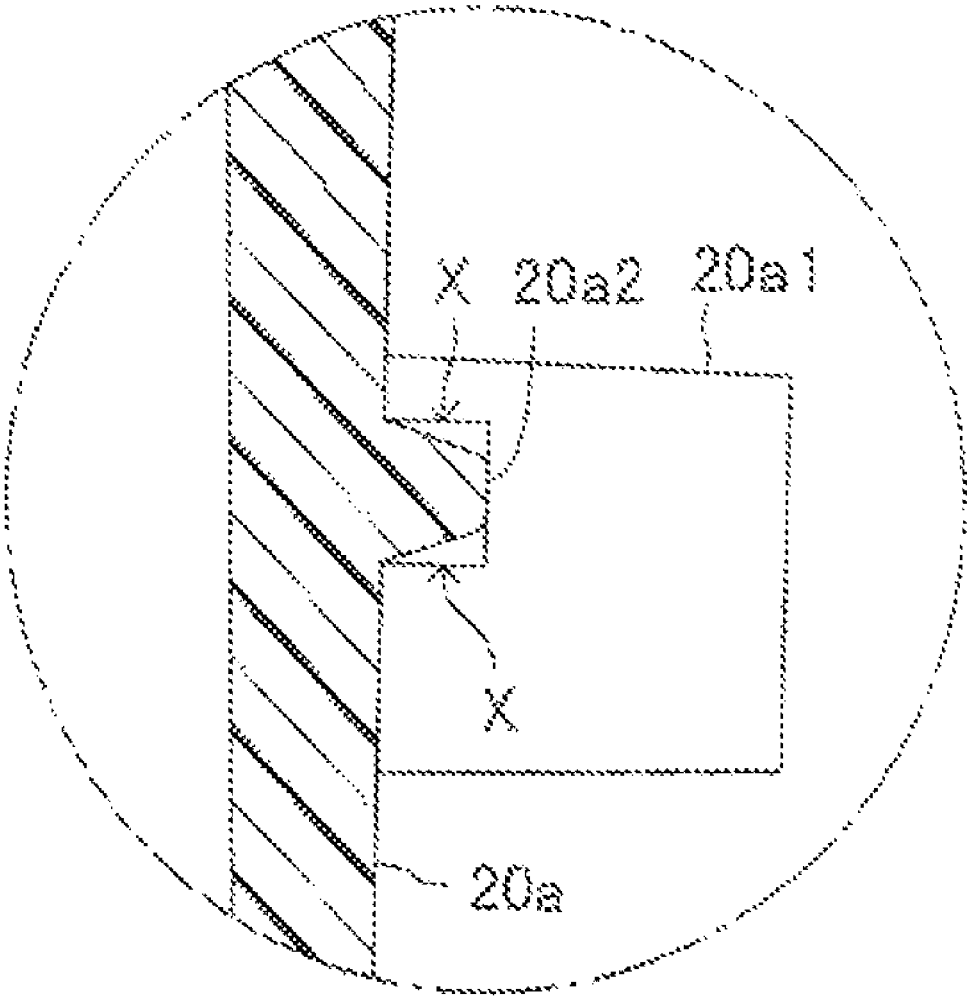
FIG. 8*b* is an enlarged fragmentary cross-sectional side view of the keyboard frame taken along the line as viewed in the direction of the arrows B-B in FIG. 8*a*.

Further in the above-described embodiment, the ribs 20*a*2 are formed with a draft angle to facilitate the release of the molded keyboard frame 20 from the mold. Accordingly, the upper surface of the rib 20*a*2 is descending rearward (toward its tip). With such a configuration, if the integrated multikey unit 10A, 10B, 10C is displaced rearward when the groove 13*b* of the multikey subunit 10C engages with the rib 20*a*2, the integrated multikey unit 10A, 10B, 10C is apt to slip off the rib 20*a*2. To prevent such a possibility, some parts of the rib 20*a*2 in a predetermined length (in the width direction) are formed with a horizontal upper surface and a horizontal lower surface as shown by X in FIGS. 8*a* and 8*b*. In such a case, the corresponding parts of the groove 13*b* of the multikey subunit 10C is also formed with a horizontal upper and lower surfaces. With this configuration, even if the integrated multikey unit 10A, 10B, 10C is displaced rearward when the groove 13*b* of the multikey subunit 10C engages with the rib 20*a*2, the integrated multikey unit 10A, 10B, 10C will move horizontally and would not easily slip off the rib 20*a*2. While the modified example shown in FIGS. 8*a* and 8*b* employs the rib 20*a*2 having a horizontal upper and lower surfaces at the parts of a predetermined length in the width direction, only the upper surface may be formed flat and the lower surface may be formed with a draft angle. With such a further modification, the same effects will be obtained as with the above modification shown in FIGS. 8*a* and 8*b*.

The present invention has been described in connection with an embodiment which comprises swing levers 25 for simulating the key touch feeling on an acoustic piano. The present invention is, of course, applicable to a keyboard assembly for an electronic musical instrument which need not simulate the key touch feeling on an acoustic piano. For such an electronic musical instrument, the above-described swing levers 25 may be omitted and some urging members (e.g. springs) may be provided instead to urge the front part of the key bodies 11 upward. In such an electronic musical instrument also, the multikey unit 10A, 10B, 10C can be easily assembled to the keyboard frame.

While several preferred embodiments have been described and illustrated in detail herein above with reference to the drawings, it should be understood that the illustrated embodiments are just for preferable examples, that the present invention may not necessarily be limited to the illustrated embodiments, and that the present invention can be practiced with various modifications, improvements and combinations without departing from the spirit of the present invention.

What is claimed is:

1. A keyboard assembly for an electronic musical instrument comprising:

an integrally formed multikey unit having a plurality of juxtaposed key bodies each of which is extended downward from its rear end to form a deformable thickness-reduced member to allow vertical swing of the key body when depressed by a player, and having a common connecting member to which is connected the thickness-reduced members to horizontally align the key bodies in the direction of juxtaposition; and a keyboard frame having a vertical rear wall member and a rear top wall member positioned in front of and above the vertical rear wall member, the vertical rear wall member and the rear top wall member extending in the direction of the key body alignment, wherein the keyboard frame is provided with a guide member connecting the rear top wall member and the vertical rear wall member, whereby the multikey unit is to be mounted onto the keyboard frame by placing the common connecting member over the rear top member, thereafter sliding the common connecting member along the guide member, and finally fixing the common connecting member to the vertical rear wall member.

2. A keyboard assembly as claimed in claim 1, wherein the guide member is provided in the form of a rib between the rear end of the rear top member and the top end of the vertical rear wall member.

3. A keyboard assembly as claimed in claim 1, wherein the guide member is provided in the form of a slant wall connecting the rear end of the rear top member and the top end of the vertical rear wall member.

4. A keyboard assembly as claimed in claim 1, further comprising:

a first protrusion protruding from the vertical rear wall member rearward, wherein the common connecting member abuts against the first protrusion when the multikey unit is mounted onto the keyboard frame.

5. A keyboard assembly as claimed in claim 4, wherein the common connecting member has a cutaway provided from the lower edge of the common connecting member to engage with the first protrusion when the common connecting member is fixed to the vertical rear wall member.

6. A keyboard assembly as claimed in claim 4, wherein the first protrusion is provided in the form of a boss for fixing the common connecting member to the vertical rear wall member.

7. A keyboard assembly as claimed in claim 4, further comprising:

a second protrusion protruding from the vertical rear wall member rearward and extending on the vertical rear wall member in the direction of the key body alignment, and wherein the common connecting member is provided with a groove to match the second protrusion, whereby the common connecting member is fixed to the vertical rear wall member with the groove in the common connecting member engaging with the second protrusion on the vertical rear wall member.

8. A keyboard assembly as claimed in claim 7, wherein the second protrusion is protruded from the vertical rear wall member by an amount which is smaller than the thickness of the common connecting member.

9. A keyboard assembly as claimed in claim 7, wherein the second protrusion has a length of part extending in the direction of the key alignment which part is formed to have a horizontal surface area.

10. A keyboard assembly as claimed in any one of claims 1-9, further comprising:

a swing member which is supported by the keyboard frame, linked to the key body and which swings according to the depression of the key body.

* * * * *